US007004072B1

(12) United States Patent
Ceola

(10) Patent No.: US 7,004,072 B1
(45) Date of Patent: Feb. 28, 2006

(54) MAGNETICALLY SENSED SECOND ENVIRONMENT SAFETY AND ARMING DEVICE

(75) Inventor: Kenneth D. Ceola, Apple Valley, MN (US)

(73) Assignee: Alliant Techsystems Inc., Edina, MN (US)

( * ) Notice: Subject to any disclaimer, the term of this patent is extended or adjusted under 35 U.S.C. 154(b) by 867 days.

(21) Appl. No.: 09/538,785

(22) Filed: Mar. 30, 2000

(51) Int. Cl.
*F42C 15/00* (2006.01)
*F42C 15/24* (2006.01)

(52) U.S. Cl. ..... 102/221; 102/248; 102/249

(58) Field of Classification Search ..... 102/221, 102/248, 249; 87/6; 89/6.5

See application file for complete search history.

(56) References Cited

U.S. PATENT DOCUMENTS

| | | | | |
|---|---|---|---|---|
| 3,608,494 | A * | 9/1971 | Ziemba | 102/235 |
| 4,072,108 | A * | 2/1978 | Lewis et al. | 102/209 |
| 4,483,190 | A * | 11/1984 | Cornett | 73/167 |
| 4,633,779 | A * | 1/1987 | Biggs et al. | 102/215 |
| 4,862,785 | A * | 9/1989 | Ettel et al. | 89/6.5 |
| 5,265,539 | A * | 11/1993 | Kurschner et al. | 102/206 |
| 5,394,853 | A * | 3/1995 | Teraoka | 123/561 |
| 5,497,704 | A * | 3/1996 | Kurschner et al. | 102/264 |
| 5,693,906 | A | 12/1997 | Van Sloun | 102/251 |
| 6,196,130 | B1 * | 3/2001 | Crist et al. | 102/221 |
| 6,295,931 | B1 * | 10/2001 | Cutler et al. | 102/221 |

* cited by examiner

*Primary Examiner*—Teri P. Luu
(74) *Attorney, Agent, or Firm*—Vidas, Arrett & Steinkraus, P.A.

(57) ABSTRACT

The fuze is armed only if muzzle exit is sensed by a magnetic sensor within a predetermined time after setback is sensed and either one or both of a minimum spin rate is sensed by the magnetic sensor and/or a minimum number of turns are counted.

14 Claims, 1 Drawing Sheet

MAGNETICALLY SENSED SECOND ENVIRONMENT SAFETY AND ARMING DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to safety and arming devices for use with fuzes and more particularly, to a magnetic sensor which senses muzzle exit, spin rate and count turns.

A safety and arming device is a required element of a munition to ensure that the munition is not armed and detonated until the desired time. The safety and arming device (S & A) is part of a munition's fuze and prevents arming of the fuze until certain conditions are met.

MIL-STD-1316 requires two unique environments or occurrences for fuze arming. The first environment utilized is usually setback for gunfired munition fuzing. Setback acceleration of gunfired munitions, due to its large magnitude, is an easily mechanically sensed environment. Fuze power is frequently not available at setback necessitating a mechanical environment sensor. Effective mechanically sensed second environments are much more difficult as set forward and spin, for example, can be relatively low, difficult to mechanically sense, and not sufficiently unique to gunfire to provide adequate safety. A second environment, electrically sensed, such timing, barrel escape or turns counting can be used to increase safety and satisfy MIL-STD-1316.

Many different setback determination devices exist, such as U.S. Pat. No. 5,693,906, entitled "Electro-Mechanical Safety And Arming Device", which is commonly owned with this application. Muzzle exit determination and turns counting is also provided in many prior art devices, such as U.S. Pat. No. 5,497,704, entitled "Multifunctional Magnetic Fuze", which is also commonly owned with this application. The entire contents of these references are hereby incorporated by reference.

There is always a need to make the safety and arming devices of any device utilizing a fuze as safe as possible.

BRIEF SUMMARY OF THE INVENTION

The present invention provides a safer safety and arming device which utilizes a magnetic sensor to determine two or more events, such as muzzle exit, spin rate, and count turns, and also ensures that the determined events occur in the correct order and at the expected time. The magnetic sensor data may also be combined with other events, such as setback to substantially increase the safety of gunfired fuze systems.

These and other advantages and features which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a preferred embodiment to the invention.

BRIEF DESCRIPTION OF THE SEVERAL VIEWS OF THE DRAWINGS

Referring to the Drawings, wherein like numerals represent like parts throughout the several views.

DETAILED DESCRIPTION OF THE INVENTION

Figure 1:
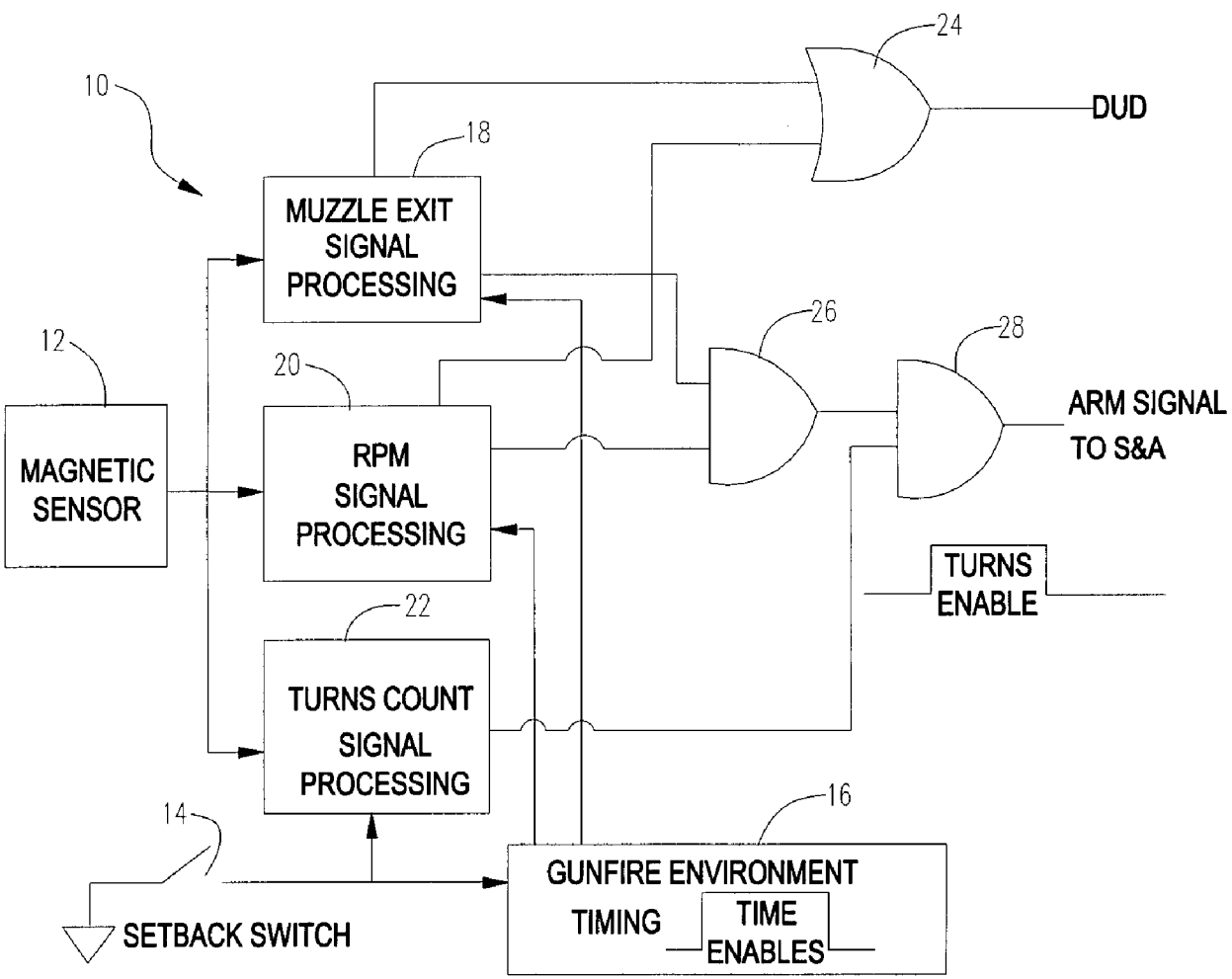
FIG. 1 is a block diagram of the safety and arming apparatus of the invention.

While this invention may be embodied in many different forms, there are described in detail herein specific preferred embodiments of the invention. This description is an exemplification of the principles of the invention and is not intended to limit the invention to the particular embodiments illustrated.

The safety and arming apparatus is shown generally at 10 in FIG. 1 and includes a magnetic sensor 12, a setback switch 14, a timing device 16, a muzzle exit signal processing block 18, a spin rate signal processing block 20 and a turns counting signal processing block 22. The timer is started upon the occurrence of setback, which may be determined by any known setback determination device, although the device of U.S. Pat. No. 5,693,906 is preferred. In cases where power is not available at setback (i.e. the battery is setback activated), battery rise to a specific value can be assumed as the setback time mark. The timer is output to both the muzzle exit and spin rate signal processing blocks 18 and 20. The muzzle exit signal processing block outputs a "1" to AND gate 26 only if muzzle exit is detected within a predetermined time window, based on the timer 16, which is only started upon setback. Muzzle exit is determined in accordance with the teachings of U.S. Pat. No. 5,497,704 by detecting the magnetically induced signature of the projectile as it leaves the ferrous confinement of the barrel and enters the earth's magnetic field. If the Muzzle exit signature is not detected within the expected window, a "1" signal to OR gate 24 will result in a dud.

The output of the spin rate signal processing block 22 is input to both a dud OR gate 24 and an AND gate 26. The spin rate signal processing block outputs a "1" to AND gate 26 only if the spin rate is between a predetermined minimum and maximum spin rate within a predetermined time window, based on the timer 16. If the spin rate signature is not detected within the expected window, a "1" signal to OR gate 24 will result in a dud. Both the muzzle exit and spin signal must occur within the expected time window to result in an arm enable signal from AND gate 26 to AND gate 28.

The output of the turns count signal processing block 22 is output to AND gate 28 and is enabled or set to "1" only after a predetermined number of turns of the projectile are detected with magnetic sensor 12. Only if both the output of 26 and the turns count 22 are "1" will the arm signal be set to "1" to cause the fuze to be armed, but only if the Dud signal is "0".

While not specifically detailed, it will be understood that the various electronic functional blocks are properly connected to appropriate bias and reference supplies so as to operate in their intended manner. It should also be understood that the processing described herein utilizes well known technology. Further, any circuitry configurations and applications thereof other than as described herein can be configured within the spirit and intent of this invention.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A safety and arming fuze apparatus for use with a projectile, comprising:

a magnetic sensing apparatus for determining the occurrence of at least two of the events selected from the group consisting of muzzle exit, a predetermined spin rate, and a predetermined number of turns, whereby upon the occurrence of the at least two events the fuze is armed.

2. The safety and arming apparatus of claim 1 further including a timer and wherein the magnetic sensing apparatus is programmed to arm the fuze only if the at least two events occur in a predetermined order in a predetermined time window.

3. The safety and arming apparatus of claim 2 further including a setback sensor and wherein the fuze is armed only if setback occurs and the at least two events occur in a predetermined order.

4. The safety and arming apparatus of claim 3 wherein the fuze is armed only if muzzle exit occurs within a predetermined time window from when setback occurs.

5. The safety and arming apparatus of claim 1 wherein the at least two events are a predetermined spin rate and a predetermined number of turns.

6. The safety and arming apparatus of claim 1 wherein the at least two events are muzzle exit, a predetermined spin rate, and a predetermined number of turns.

7. The safety and arming apparatus of claim 1 wherein the at least two events are muzzle exit, spin rate, and turns in a predetermined time window.

8. The safety and arming apparatus of claim 1 wherein the at least two events are muzzle exit and a predetermined number of turns.

9. The safety and arming apparatus of claim 1 wherein the fuze is armed only if the spin rate is between a predetermined minimum and maximum spin rate within a predetermined time window.

10. A method for safing and arming a projectile, the steps comprising:

a) determining the occurrence of at least two of the events selected from the group consisting of muzzle exit, a predetermined spin rate, and a predetermined number of turns, b) arming the fuze.

11. The method of claim 10 further including the step of arming the fuze only if a setback event occurs.

12. The method of claim 11 further including the step of arming the fuze only if the event of muzzle exit occurs within a predetermined time from when setback occurs.

13. The method of claim 12 further including the step of arming the fuze only if the spin rate is between a predetermined minimum and maximum spin rate.

14. The method of claim 13 further including the step of arming the fuze only after the projectile has turned a predetermined number of turns.

* * * * *